US005584087A

United States Patent [19]

Acott, II

[11] Patent Number: 5,584,087

[45] Date of Patent: Dec. 17, 1996

[54] RAKE FOR MOVING BUBBLES IN A WATERBED

[76] Inventor: Melvin E. Acott, II, P. O. Box 575, Hominy, Okla. 74035

[21] Appl. No.: 390,234

[22] Filed: Feb. 17, 1995

Related U.S. Application Data

[63] Continuation of Ser. No. 58,459, May 6, 1993, abandoned.

[51] Int. Cl.[6] ..... A47C 31/00

[52] U.S. Cl. ..... 5/658

[58] Field of Search ..... 56/400.01; 294/19.2; 5/658; 172/371, 377; 273/126 R

[56] References Cited

U.S. PATENT DOCUMENTS

| | | | |
|---|---|---|---|
| 797,675 | 8/1905 | Fletcher | 273/126 R |
| 1,929,128 | 10/1933 | Vidmar | 172/371 |
| 2,011,062 | 8/1935 | Masamitsu | 172/371 |
| 2,015,916 | 10/1935 | Blocher | 173/371 |
| 2,056,411 | 10/1936 | Schulz | 56/400.01 |
| 2,315,074 | 3/1943 | Olsen | 172/371 |
| 2,817,405 | 12/1957 | Pearson | 294/19.2 |
| 3,293,674 | 12/1966 | Sapia | 172/371 |
| 3,520,569 | 7/1970 | Anderson | 294/19.2 |
| 3,545,551 | 12/1970 | Niemeyer | 172/371 |
| 3,604,149 | 9/1971 | Salontai | 273/126 R |
| 4,091,564 | 5/1978 | Jasinski | 273/126 R |
| 4,191,261 | 3/1980 | Tarantino | 172/371 |
| 4,414,797 | 11/1983 | Archer | 56/400.01 |
| 4,520,621 | 6/1985 | Archer | 56/400.01 |
| 4,635,987 | 1/1987 | Hurtgam | 294/19.2 |
| 4,639,961 | 2/1987 | Chasan | 5/508 |
| 4,730,859 | 3/1988 | Gabinet | 294/19.2 |
| 4,745,650 | 5/1988 | Elliott | 5/508 |
| 4,862,542 | 9/1989 | Jordan | 5/508 |
| 5,110,168 | 5/1992 | Petrillo | 294/19.2 |
| 5,303,967 | 4/1994 | Dubow | 294/19.2 |

FOREIGN PATENT DOCUMENTS

| | | | |
|---|---|---|---|
| 593022 | 2/1960 | Canada | 172/371 |
| 452157 | 8/1936 | United Kingdom | 56/400.01 |
| 878734 | 10/1961 | United Kingdom | 56/400.01 |

*Primary Examiner*—Michael J. Milano
*Attorney, Agent, or Firm*—Frank J. Catalano; Scott R. Zingerman

[57] ABSTRACT

A rake for moving an air bubble entrapped between the surface of the water in and the underside of the top of a waterbed mattress to a vent through the top of the mattress is provided consisting of an elongated member and a handle. The elongated member has a lower surface lying in substantially a single plane and spaced apart beginning and end points. A straight line connecting the beginning and end points defines a geometric area for surrounding the bubble. The handle has one end connected to the member and another end extending above the plane defined by the lower surface of the member. The handle is used for manually urging the member downwardly against an upper side of the top of the mattress to trap the bubble within the geometric area. The handle is also used for guiding the geometric area with the bubble trapped therein into communication with the vent so that the air can be released to the atmosphere. Preferably, a line extending from one end of the handle to the other is substantially perpendicular to the straight line between the member beginning and end points so as to facilitate the directing of the bubble with minimum opportunity for the bubble to escape the geometric area.

8 Claims, 3 Drawing Sheets

RAKE FOR MOVING BUBBLES IN A WATERBED

This is a continuation of application Ser. No. 08/058,459 filed on May 6, 1993 now abandoned.

BACKGROUND OF THE INVENTION

This invention relates generally to waterbeds and more particularly concerns a rake for removing air bubbles trapped inside a waterbed mattress.

Over a period of time air separates from the water in a waterbed mattress and forms large bubbles which are trapped between the water surface and the top layer of the mattress. Several devices have been devised for removing these bubbles from the mattress. They include rollers which extend the width of the bed so that the bubbles can be forced from one end of the bed to the other. Smaller rollers are then used in a direction transverse to the large roller so as to pinch the bubbles to the vent in the top of the waterbed mattress. These devices are generally clumsy and require more than one person for their operation. When properly operated, the bubbles are broken and distributed across the width of the bed and have to be recollected into a central location. These multiple operations generally result in portions of the collected bubbles escaping the confines of the longer roller while the smaller rollers are being manipulated, thus requiring a repetition of the task. A smaller more manipulable device in the form of a straight edge paddle has been devised so that a single person can manipulate a bubble by the application of force at the edge of the paddle. However, the bubbles easily escape the limited confines of the paddle edge and are very difficult to direct along the shortest path to the vent.

It is, therefore, an object of this invention to provide a rake which facilitates moving of a bubble in a waterbed mattress to a mattress vent to be exhausted to the atmosphere. It is also an object of this invention to provide a rake which traps an air bubble in a limited geometric area for movement therewith to the mattress vent. Another object of this invention is to provide a rake which holds the bubble in a unified condition, rather than causes the bubble to be broken and dispersed. Yet another object of this invention is to confine a bubble within a geometric area that is readily directable to the mattress vent along the shortest path between the bubble and the vent. Still another object of this invention is to provide a rake which allows a single user to simultaneously apply a downward trapping force and a lateral moving force without the bubble or any portion thereof escaping from the rake.

SUMMARY OF THE INVENTION

In accordance with the invention, a rake for moving an air bubble entrapped between the surface of the water in and the underside of the top of a waterbed mattress to a vent through the top of the mattress is provided consisting of an elongated member and a handle. The elongated member extends between spaced apart beginning and end points and has a lower surface lying in substantially a single plane. A straight line connecting the beginning and end points defines a geometric area for surrounding the bubble. Alternatively, the beginning and end points of the elongated member may be joined to form a continuous member.

The handle has one end connected to the member and another end extending above the plane defined by the lower surface of the member. The handle is used for manually urging the member downwardly against an upper side of the top of the mattress to trap the bubble within the geometric area. The handle is also used for guiding the geometric area with the bubble trapped therein into communication with the vent so that the air can be released to the atmosphere.

Preferably, a line extending from one end of the handle to the other is substantially perpendicular to the straight line between the member beginning and end points so as to facilitate the directing of the bubble with minimum opportunity for the bubble to escape the geometric area.

In one preferred set of embodiments, this member consists of a plurality of linear submembers connected in end to end relationship by a plurality of elbows therebetween. In these embodiments, the geometric area may be trapezoidal, rectangular, triangular or of other desired configuration. Preferably, in a trapezoidal configuration, the trapezoid will be symmetrical and the handle perpendicularly connected to the center of the shorter of its parallel sides with the straight line being the longer of the parallel sides. This trapezoid will also preferably have acute angles in a range of approximately 45 degrees. In the rectangular configuration, the handle preferably will be perpendicularly connected to the center of the side opposite the straight line. In the triangular configuration, the triangle will preferably be isosceles and the handle connected to an apex of the triangle opposite the straight line at an angle bisecting the apex. Preferably, the apex will be substantially a right angle.

Preferably, the handle includes a first segment with one end connected to the member and extending upwardly therefrom to another end at a first angle relative to the plane of the geometric area and a second segment connected at one end to the other end of the first segment and extending at a second angle relative to the plane. This positions the grip of the handle to facilitate the downward pressure on the member and the simultaneous guiding motion of the member. In one variation, the handle has a fork at one end with one prong connected to the beginning point and the other prong connected to the end point of the elongated member so that pressure can be exerted at both ends of the member. The fork may also extend upwardly from the member to the handle at a first angle relative to the plane and the handle extend from the fork at a second angle relative to the plane of the geometric area for the reasons hereinbefore explained. In any case, the handle may extend forwardly or rearwardly of the geometric area, depending on whether it is desired to pull or push the bubble.

Preferably, the member and the handle will be of circular cross-section, though it could be square or of other configuration. A tubular member structure with end caps for closing the beginning and end points of the member and the handle is preferred.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
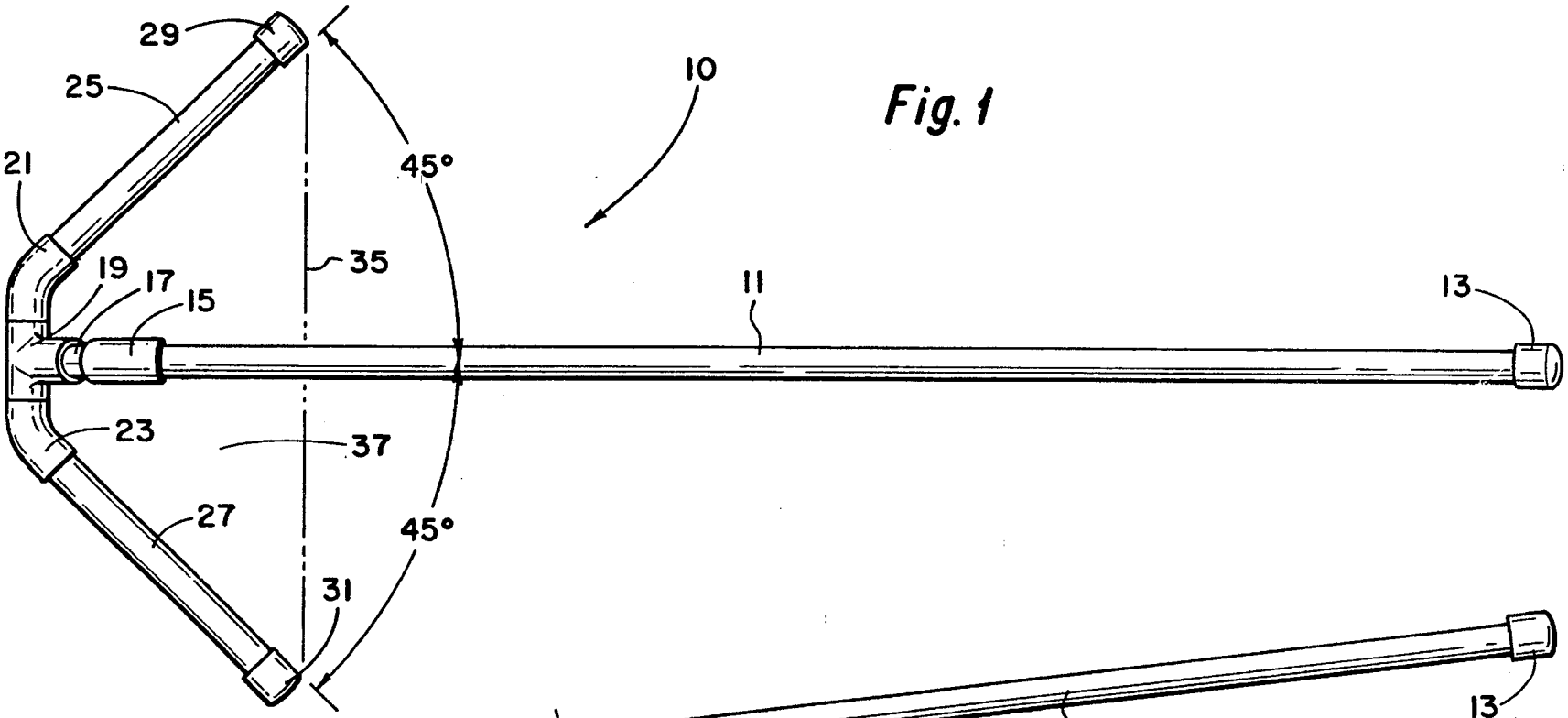
FIG. 1 is a top plan view of a narrow trapezoidal embodiment of the rake.

Turning first to FIG. 1 a narrow trapezoidal embodiment 10 of the rake is illustrated in which an elongated handle 11 extends from an end cap 13 to an elbow 15 which turns downwardly to an extension 17 which is connected to a tee 19 at the short parallel side of a trapezoid. From the short parallel side 19, the trapezoid is defined by elbows 21 and 23 connected to arms 25 and 27 of the trapezoid. As shown, the arms 25 and 27 are provided with end caps 29 and 31. Thus, beginning with one end cap 29 and ending with the other end cap 31, one arm 25, one elbow 21, the tee 19, the other elbow 23 and the other arm 27 define an elongated member having a lower surface lying in substantially a single plane 33. Also, a straight line 35 connecting the end caps 29 and 31, together with the lower surface of the elongated member defining the plane 33, establishes a substantially narrow trapezoidal geometric area 37. Alternatively, the beginning and end points of the elongated member may be joined to form a continuous member. As shown in this preferred embodiment, the trapezoidal area 37 is substantially isosceles with and the handle 11 bisecting the short parallel side and perpendicular to the straight line 35. As is also shown in this embodiment, the extension 17 is at a first angle 39 with respect to the plane 33 while the handle 11 is at a second angle 41 with respect to the plane 33.

Figure 2:
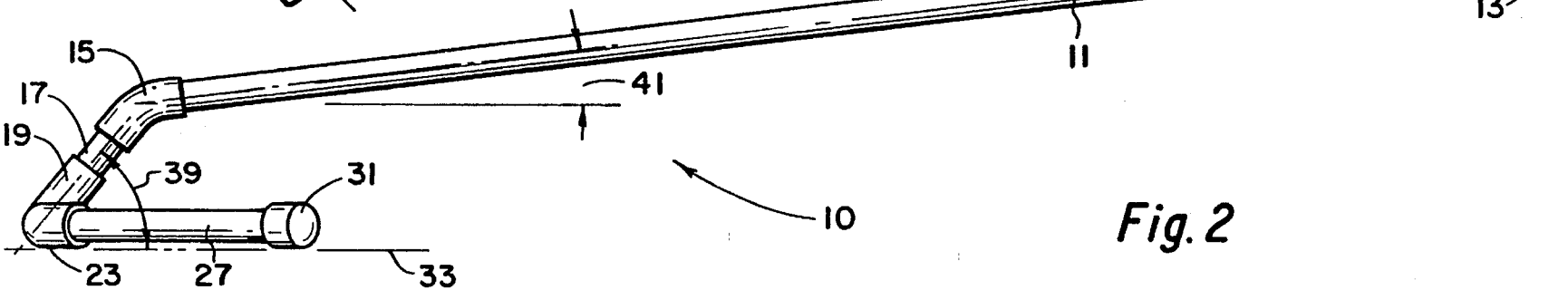
FIG. 2 is a side elevation view of the rake of FIG. 1.
Figure 3:
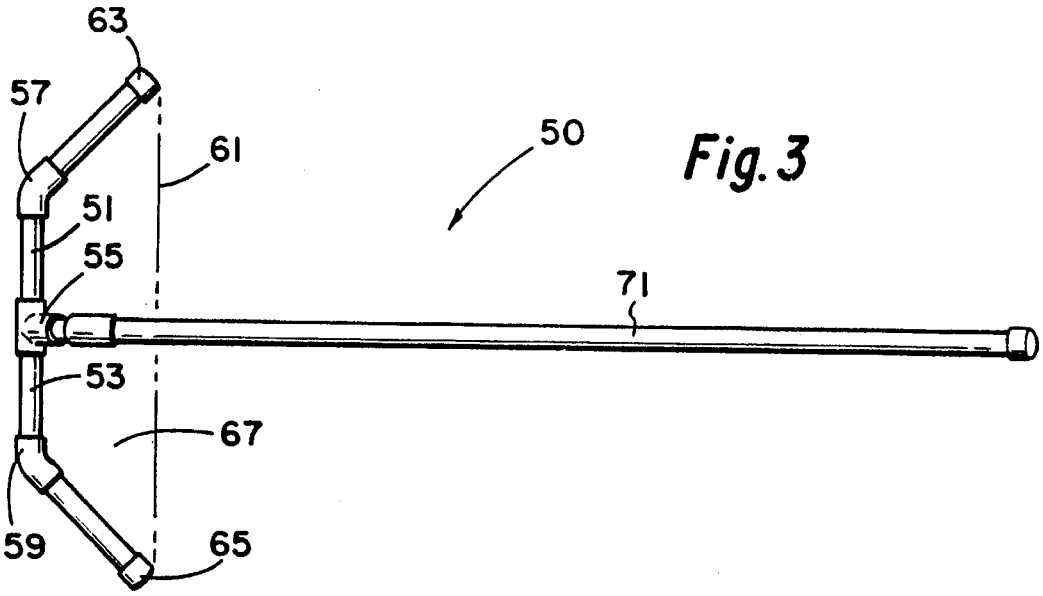
FIG. 3 is a top plan view of a wide trapezoidal embodiment of the rake.
Figure 4:
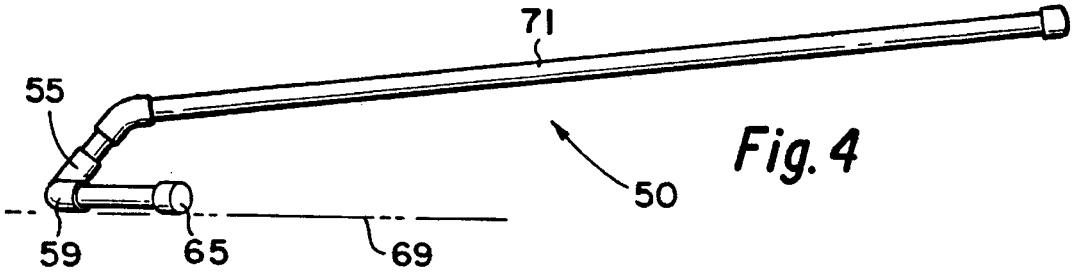
FIG. 4 is a side elevation view of the rake of FIG. 3.

While the short parallel side of the trapezoidal area 37 is flattened out as a result of the structural tee 19 and elbows 21 and 23, it is substantially narrower in relation to a wider trapezoidal embodiment 50 of the rake illustrated in FIGS. 3 and 4. This embodiment is similar to the embodiment illustrated in FIGS. 1 and 2 in all respects except in that sub members 51 and 53 have been connected between the tee 55 and the elbows 57 and 59 so that, with a straight line 61 connecting end caps 63 and 65, a wider trapezoidal geometric area 67 is defined. The lower surface of the members connected between the end caps 63 and 65 lies substantially in a single plane 69. Preferably, the handle 71 extends to the center of the short parallel side of the trapezoid opposite the straight line 61 which forms the long parallel side of the trapezoidal area 67 and is connected at the center of the short parallel side.

Figure 5:
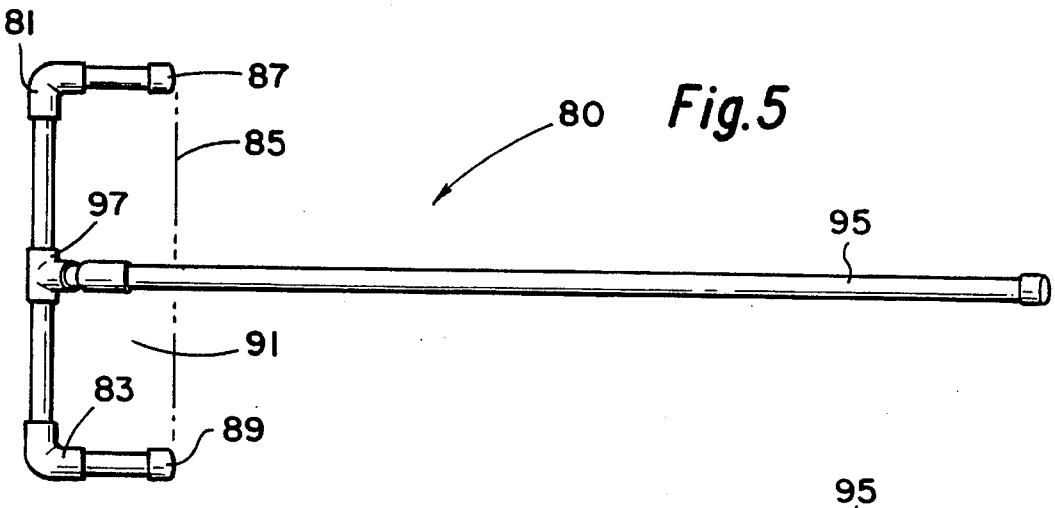
FIG. 5 is a top plan view of a rectangular embodiment of the rake.
Figure 6:
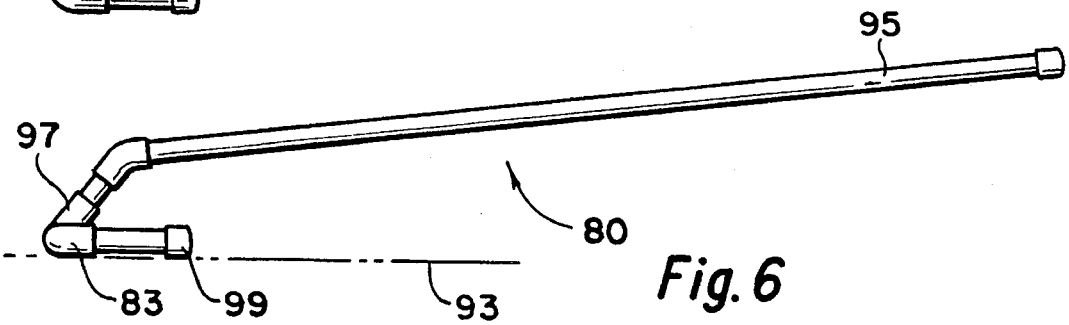
FIG. 6 is a side elevation view of the rake of FIG. 5.

Turning now to FIGS. 5 and 6, the rectangular embodiment 80 of the rake is illustrated in which elbows 81 and 83 are at right angles so that a straight line 85 connecting end caps 87 and 89 defines a rectangular geometric area 91 when taken together with the lower surface of the member components extending from the cap 87 to the cap 89. Again, the lower surface of these components defines substantially a single plane 93 and the handle 95 is connected to the side of the rectangular area opposite the straight line 85 by a tee 97 connected at the center of that side.

Figure 7:
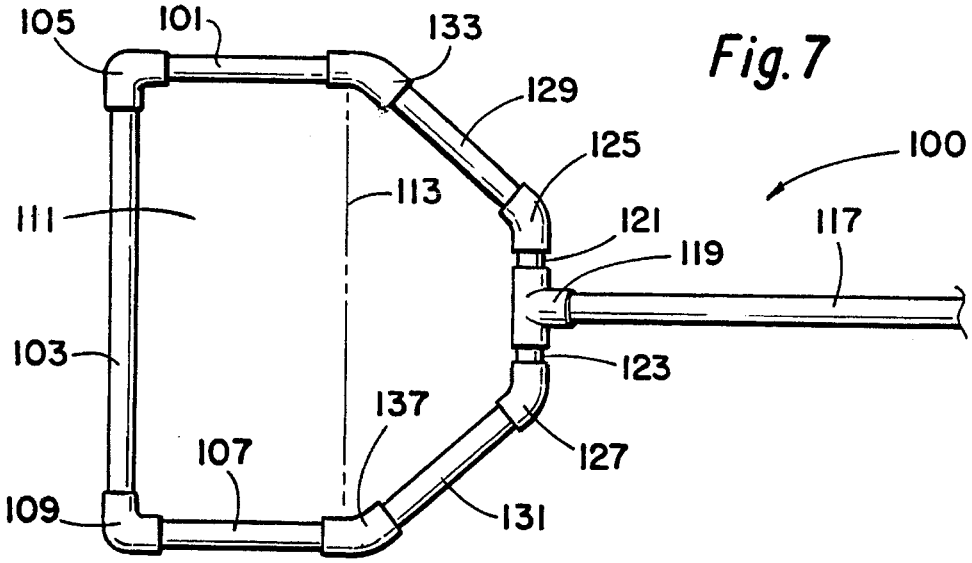
FIG. 7 is a top plan view of the bubble entrapping end of the rectangular embodiment of the rake illustrating another embodiment of the handle of the rake.
Figure 8:
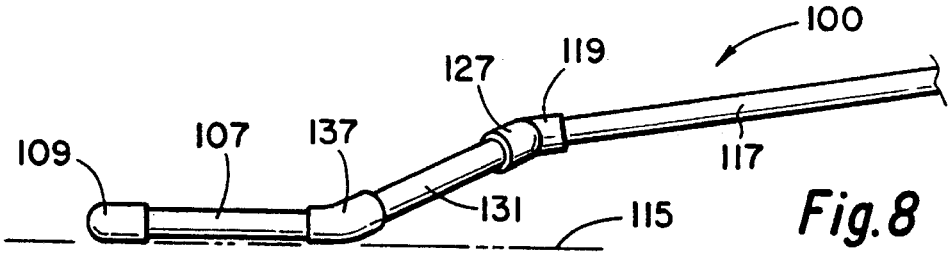
FIG. 8 is a side elevation view of the rake of FIG. 7.

Turning now to FIGS. 7 and 8, another rectangular embodiment 100 illustrating a different handle connection than that previously illustrated is shown. In this embodiment, the rectangular geometric area is defined by a first end member 101 connected to a side member 103 by a right angle elbow 105 and a second end member 107 connected to the side member 103 by a second right angle elbow 109. The rectangular geometric area 111 is defined by a straight line 113 connecting the ends of the end members 101 and 107. Once again, the lower surface of the sequential members forming three sides of the rectangular geometric area 111 lies in substantially a single plane 115. In this embodiment, the handle 117 extends to a tee 119 which is in turn connected by extensions 121 and 123 to elbows 125 and 127 and then to prongs 129 and 131, all forming a fork fixed to the handle 117. The ends of the prongs 129 and 131 are then connected by elbows 133 and 137 to the beginning and end points of the elongated member constituted by the ends of the end members 101 and 107.

Figure 9:
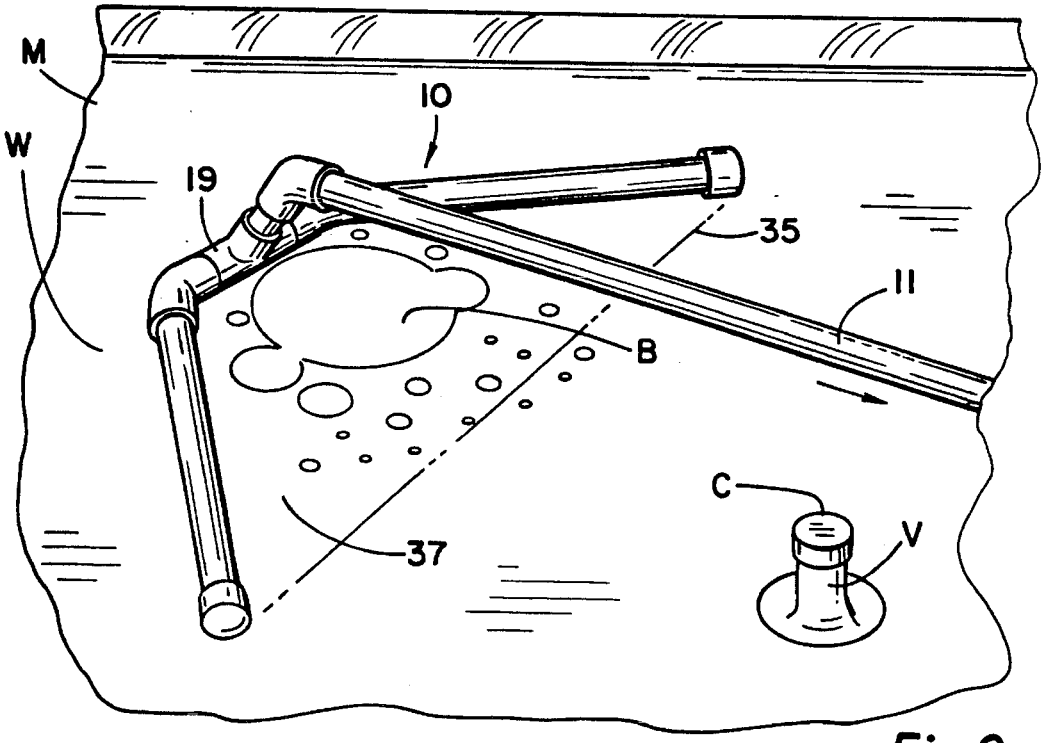
FIG. 9 is a perspective view of a portion of a waterbed mattress and a narrow trapezoidal embodiment of the rake with parts broken away illustrating the use of the rake.

Turning now to FIG. 9, the operation of the rake is illustrated in relation to the narrow trapezoidal embodiment 10 of FIGS. 1 and 2 moving a bubble B from their location between the top surface of the water W and the underside of the top of the mattress M toward the vent V in the top of the mattress M. Downward pressure on the handle 11 seals the surface of the mattress M to the surface of the water W to trap the bubble B within the confines of the triangular area 37. While the downward force on the handle 11 is maintained, the handle is drawn in a direction from the bubble B toward the vent V. As this motion toward the vent V continues, other bubbles along the path will also be collected within the geometric area 37 as they are crossed by the line 35. In this narrow trapezoidal embodiment 10, the rake has the special advantage of gathering the bubbles toward the short parallel side 19 so that they can be better concentrated toward the vent V. When the trapezoidal area 37 has been shifted to encompass the area below the vent V, the bubble B can be brought directly under the vent V so that with the cap C of the vent V in the open condition, the bubble B will be permitted to vent to the atmosphere.

The particular embodiments shown and described herein are illustrative of the general principles of the rake. Any of a number of geometric areas may be employed including the narrow trapezoid, rectangle and wide trapezoid illustrated or semi-circular or semi-elliptical or other configurations. The angular relationships in the trapezoidal configurations can be modified to suit any user. In any geometric configuration, the handle may be connected by a single connector or in a fork configuration. Adjustable wing nut arrangements could be employed so that the angular relationship of the handle components to the plane of the bubble moving members can be varied to accommodate the user. The angle of the handle may be such that the handle extends forwardly or rearwardly of the geometric area so that the bubble can be moved by pushing or pulling the rake, whichever is preferred by the user. The handle may be short, long or extendable. The bubble moving members themselves may be flexible or bendable so as to permit the user to arrange them in any desired configuration depending on the disposition of the bubbles within the mattress. The components may be made of metal, wood, plastic, fiberglass or any suitable material and may be of round cross-section as illustrated or any other desired cross-sectional configuration. Preferably, all of the members will be made of tubular polyvinyl chloride and will be connected with tee's, elbows and end caps also of polyvinyl chloride.

Thus, it is apparent that there has been provided, in accordance with the invention, a rake for waterbed bubbles that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A toothless rake for moving an air bubble entrapped between the surface of the water in and the underside of the top of a waterbed mattress to a vent through the top of the mattress comprising:

an elongated member having a lower surface in substantially a single plane and having spaced apart beginning and end points, said member, together with a straight line connecting said beginning and end points, defining a trapezoidal geometric area for surrounding the bubble, said straight line being a longer of parallel sides of said trapezoidal area; and a handle having one end thereof perpendicularly connected to a shorter of said parallel sides of said trapezoidal area and another end thereof extending above said plane for manually urging said lower surface of said member downwardly against an upper side of the top of the mattress to trap the bubble within said geometric area and for guiding said geometric area and the bubble trapped therein into communication with the vent.

2. A rake according to claim 1, a line extending from said one end to said another end of said handle being substantially perpendicular to said straight line between said member beginning and end points.

3. A rake according to claim 1, said member comprising a plurality of linear submembers connected in end to end relationship by a plurality of elbows therebetween.

4. A rake according to claim 1, said trapezoid having acute angles in a range of approximately 45 degrees.

5. A rake according to claim 1, said handle comprising:

a first segment having one end connected to said member and extending upwardly from said member to another end of said segment at a first angle relative to said plane; and a second segment connected at one end thereof to said another end of said first segment and extending at a second angle relative to said plane.

6. A rake according to claim 1, said member being of circular cross-section.

7. A rake according to claim 1, said member being tubular.

8. A rake according to claim 7 further comprising end caps for closing said beginning and end points of said tubular member.

* * * * *